US012108860B2

(12) United States Patent
Yang

(10) Patent No.: US 12,108,860 B2
(45) Date of Patent: Oct. 8, 2024

(54) SIDE-OPERATED MAKEUP PEN

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 127 days.

(21) Appl. No.: 17/954,346

(22) Filed: Sep. 28, 2022

(65) Prior Publication Data

US 2024/0032669 A1 Feb. 1, 2024

(30) Foreign Application Priority Data

Jul. 26, 2022 (CN) ..... 202210883858.1

(51) Int. Cl.

| | |
|---|---|
| ***A47L 13/22*** | (2006.01) |
| ***A45D 34/04*** | (2006.01) |
| ***A45D 40/26*** | (2006.01) |
| ***A46B 11/00*** | (2006.01) |
| *A45D 34/00* | (2006.01) |

(52) U.S. Cl.

CPC ..... *A45D 34/04* (2013.01); *A45D 34/042* (2013.01); *A45D 40/26* (2013.01); *A45D 40/262* (2013.01); *A46B 11/0055* (2013.01); *A46B 11/0065* (2013.01); *A45D 2034/005* (2013.01); *A45D 2200/055* (2013.01)

(58) Field of Classification Search

CPC ..... A45D 34/04; A45D 34/042; A45D 40/26; A45D 40/262; A45D 2034/005; A45D 2200/055; A46B 11/0055; A46B 11/0065

USPC ..... 401/270

See application file for complete search history.

(56) References Cited

U.S. PATENT DOCUMENTS

| | | | | |
|---|---|---|---|---|
| 6,056,470 | A | 5/2000 | Nehashi et al. | |
| 8,985,885 | B2 * | 3/2015 | Kang | A45D 34/042 401/187 |
| 11,930,907 | B1 * | 3/2024 | Yang | A45D 34/04 |

FOREIGN PATENT DOCUMENTS

| | | | |
|---|---|---|---|
| CN | 203369531 | U | 1/2014 |
| CN | 108577143 | A | 9/2018 |
| CN | 213154581 | U | 5/2021 |

(Continued)

*Primary Examiner* — Jennifer C Chiang

(74) *Attorney, Agent, or Firm* — Bayramoglu Law Offices LLC

(57) ABSTRACT

A side-operated makeup pen includes an applicator assembly, a coupling member, an operable member, a discharge assembly, and a container assembly. The discharge assembly includes a transmission member and a compression member that are connected to each other. The compression member is elastic. The coupling member includes a first end connected to the applicator assembly, and a second end detachably connected to the container assembly. The transmission member and the compression member are provided in the coupling member. The operable member is provided on a sidewall of the coupling member. A first valve is arranged between the first end of the discharge assembly and the applicator assembly. A second valve is arranged between the second end of the discharge assembly and the container assembly. Therefore, the material can be added to the applicator assembly through a one-handed operation of the user, and the use is very convenient.

14 Claims, 4 Drawing Sheets

(56) References Cited

FOREIGN PATENT DOCUMENTS

| | | | |
|---|---|---|---|
| CN | 218185686 | U | 1/2023 |
| KR | 20080087464 | A | 10/2008 |
| KR | 20100003580 | U | 4/2010 |

* cited by examiner

SIDE-OPERATED MAKEUP PEN

CROSS REFERENCE TO THE RELATED APPLICATIONS

This application is based upon and claims priority to Chinese Patent Application No. 202210883858.1, filed on Jul. 26, 2022, the entire contents of which are incorporated herein by reference.

TECHNICAL FIELD

The present application relates to the field of cosmetics and in particular to a side-operated makeup pen.

BACKGROUND

With the improvement of people's living standards, cosmetics are applied increasingly and developed with more varieties and for more purposes. For most existing makeup pens, the material is supplied by means of rotation, that is, a cosmetic liquid in a nib is added by rotating a rotary portion in use. However, such makeup pens are operated with the assistance of two hands and thus are inconvenient for use.

SUMMARY

In view of the above defects, the present application provides a side-operated makeup pen. Since an operable member of the makeup pen is provided on the sidewall of a coupling member, the user can operate the operable member with one hand to add the cosmetic material on the applicator assembly during the process of applying makeup, and thus, the use is very convenient.

To solve the technical problem, the present application adopts the following technical solutions:

A side-operated makeup pen includes an applicator assembly, a coupling member, an operable member, a discharge assembly, and a container assembly, where the discharge assembly includes a transmission member and a compression member that are connected to each other. The compression member is elastic. The coupling member includes a first end connected to the applicator assembly, and a second end detachably connected to the container assembly. The transmission member and the compression member are provided in the coupling member. The operable member is provided on a sidewall of the coupling member. A first valve is arranged between the first end of the discharge assembly and the applicator assembly. A second valve is arranged between the second end of the discharge assembly and the container assembly.

Optionally, a first oblique surface may be provided on the operable member. A second oblique surface cooperating with the first oblique surface may be provided on the transmission member. The operable member is configured to drive the transmission member to move along an axial direction of the coupling member to compress the compression member.

Optionally, an elastic member may be provided between the transmission member and the compression member. The elastic member may include a first end abutting against the transmission member, and a second end abutting against the compression member.

Optionally, the first valve may be arranged between the applicator assembly and the transmission member, and the second valve may be arranged between the container assembly and the compression member;

or, the first valve may be arranged between the applicator assembly and the compression member, and the second valve may be arranged between the container assembly and the transmission member.

Optionally, the discharge assembly may further include a discharge rod and a bottle shoulder. The discharge rod may be fixedly provided in the first end of the coupling member, and the discharge rod may be fixedly sleeved on the applicator assembly. The bottle shoulder may be fixedly provided in the second end of the coupling member. The first valve may be provided on the discharge rod and can open or close. The second valve may be provided on the bottle shoulder and can open or close.

Optionally, each of the first valve and the second valve may be a one-way valve. An opening direction of the first valve may be a direction from the discharge assembly to the applicator assembly. An opening direction of the second valve may be a direction from the container assembly to the discharge assembly.

Optionally, the side-operated makeup pen may further include an outer cover. The outer cover may cover the applicator assembly. The applicator assembly may include an application head, a nib, and an application head seat. The application head may be fixedly provided on the application head seat, and the application head may communicate with a liquid passage in the application head seat. The nib may be fixedly sleeved outside the application head and the application head seat.

Optionally, the container assembly may include a bottle, a piston, and a tail plug. The tail plug may be firmly plugged at the tail end of the bottle. The piston may be hermetically provided in the bottle on the inner side of the tail plug. An air vent communicating with the outside may be formed in the tail plug.

Optionally, the side-operated makeup pen may further include a replacement assembly. The replacement assembly may include the container assembly and a replacement cover. The replacement cover may cover the container assembly.

The present application further provides another side-operated makeup pen, including an applicator assembly, a coupling member, an operable member, a discharge assembly, and a container assembly, where the discharge assembly includes a transmission member and a compression member that are connected to each other. An elastic member is provided between the transmission member and the compression member. The coupling member includes a first end connected to the applicator assembly, and a second end detachably connected to the container assembly. The transmission member and the compression member are provided in the coupling member. The operable member is provided on a sidewall of the coupling member. A first valve is arranged between the first end of the discharge assembly and the applicator assembly. A second valve is arranged between the second end of the discharge assembly and the container assembly.

Optionally, a first oblique surface may be provided on the operable member. A second oblique surface cooperating with the first oblique surface may be provided on the transmission member. The operable member is configured to drive the transmission member to move along an axial direction of the coupling member to compress the compression member.

Optionally, the first valve may be arranged between the applicator assembly and the transmission member, and the second valve may be arranged between the container assembly and the compression member;

or, the first valve may be arranged between the applicator assembly and the compression member, and the second valve may be arranged between the container assembly and the transmission member.

Optionally, the second end of the transmission member may be slidably connected in an accommodation cavity of the compression member.

Optionally, the discharge assembly may further include a discharge rod and a bottle shoulder. The discharge rod may be fixedly provided in the first end of the coupling member, and the discharge rod may be fixedly sleeved on the applicator assembly. The bottle shoulder may be fixedly provided in the second end of the coupling member. The first valve may be provided on the discharge rod and can open or close. The second valve may be provided on the bottle shoulder and can open or close.

Optionally, each of the first valve and the second valve may be a one-way valve. An opening direction of the first valve may be a direction from the discharge assembly to the applicator assembly. An opening direction of the second valve may be a direction from the container assembly to the discharge assembly.

Optionally, the side-operated makeup pen may further include an outer cover. The outer cover may cover the applicator assembly. The applicator assembly may include an application head, a nib, and an application head seat. The application head may be fixedly provided on the application head seat, and the application head may communicate with a liquid passage in the application head seat. The nib may be fixedly sleeved outside the application head and the application head seat.

Optionally, the container assembly may include a bottle, a piston, and a tail plug. The tail plug may be firmly plugged at the tail end of the bottle. The piston may be hermetically provided in the bottle on the inner side of the tail plug. An air vent communicating with the outside may be formed in the tail plug.

Optionally, the side-operated makeup pen may further include a replacement assembly. The replacement assembly may include the container assembly and a replacement cover. The replacement cover may cover the container assembly.

The present application has the following beneficial effects:

1) The side-operated makeup pen includes an applicator assembly, a coupling member, an operable member, a discharge assembly, and a container assembly. The discharge assembly includes a discharge rod, a transmission member, a compression member, and a bottle shoulder. The operable member is provided on a sidewall of the coupling member. During makeup, the user can press down the operable member, such that the material in the container assembly flows to the applicator assembly through the discharge assembly for use. Therefore, the user can operate the operable member with one hand to add the material to the applicator assembly, and the use is very convenient.

2) The container assembly and the applicator assembly are connected by the discharge assembly. A discharge port between the applicator assembly and the discharge assembly is opened or closed under the control of a first valve. A discharge port between the container assembly and the discharge assembly is opened or closed under the control of a second valve. Therefore, the makeup pen has a desirable sealing function without material leakage. Since each of the first valve and the second valve is a one-way valve, the material or gas in the applicator assembly does not flow back to the discharge assembly, and the material or gas in the discharge assembly does not flow back to the container assembly, thereby ensuring the quality of the material and prolonging the service life of the material.

3) The container assembly is detachably connected to the discharge assembly, and a replacement assembly is provided. When the material in a bottle is used up, the old bottle is replaced by a new one in the replacement assembly. Therefore, the applicator assembly and the press assembly are reusable to reduce the waste of resources.

4) The compression member is provided in the present application. When being elastic, the compression member is subject to a uniform pressure of the transmission member along an axial direction. The compression member is compressed and shortened overall along the axial direction when stressed. When an external force disappears, the compression member is extended under the action of its elasticity. Therefore, the compression member is stressed uniformly to prolong its service life. When the compression member is not elastic, the transmission member is directly extended to an accommodation cavity of the compression member, a discharge operation is realized by compressing the accommodation cavity, and both the compression member and the transmission member are restored by an elastic member. Therefore, the compression member does not deform to prolong the service life of the makeup pen.

Figure 1:
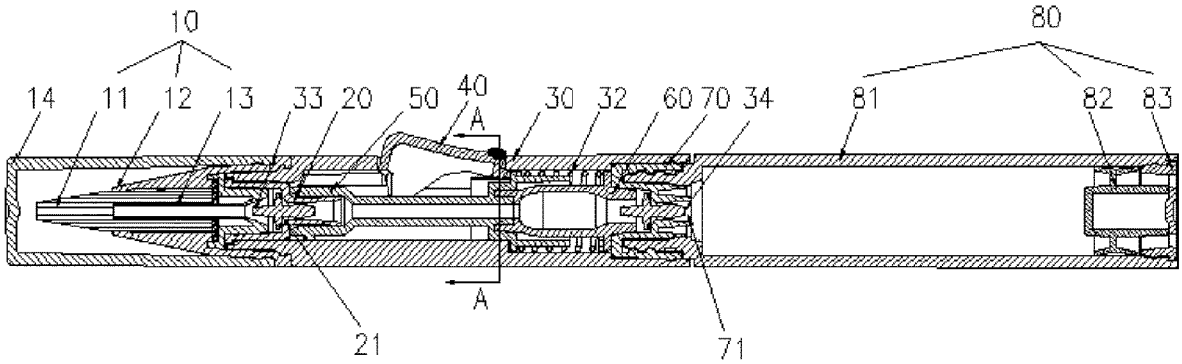
FIG. 1 is a schematic view of the structure before being pressed according to Embodiment 1 of the present application.

In the figures: 10—applicator assembly, 11—application head, 12—nib, 13—application head seat, 14—outer cover, 20—discharge rod, 21—first discharge port, 30—coupling member, 31—mounting groove, 32—elastic member, 33—first valve, 34—second valve, 40—operable member, 41—first oblique surface, 50—transmission member, 51—second oblique surface, 60—compression member, 70—bottle shoulder, 71—second discharge port, 80—container assembly, 81—bottle, 82—piston, 83—tail plug, 90—replacement assembly, and 91—replacement cover.

DETAILED DESCRIPTION OF THE EMBODIMENTS

The technical solutions in the embodiments of the present application are clearly and completely described below with reference to the embodiments of the present application. The described embodiments are merely some, rather than all of the embodiments of the present application. All other embodiments obtained by those of ordinary skill in the art based on the embodiments of the present application without creative efforts should fall within the protection scope of the present application.

It should be noted that the terms "first", "second", and so on in the description and claims of this application and the accompanying drawings are intended to distinguish similar objects but do not necessarily indicate a specific order or sequence. It should be understood that the data used in such a way may be exchanged under proper conditions to make it possible to implement the described implementations of this application in sequences except those illustrated or described herein. Moreover, the terms "include", "contain", and any other variants mean to cover the non-exclusive inclusion, for example, a process, method, system, product, or device that includes a list of steps or units is not necessarily limited to those steps or units which are listed but may include other steps or units which are not expressly listed or inherent to such a process, method, system, product, or device.

For ease of description, spatially relative terms, such as "above", "on the upper side of", "on the upper surface of," and "on" can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment 1: As shown in FIGS. 1-5, a side-operated makeup pen includes an applicator assembly 10, a coupling member 30, an operable member 40, a discharge assembly, and a container assembly 80. The discharge assembly includes a transmission member 50 and a compression member 60 that are connected to each other. The compression member 60 is elastic. The coupling member 30 includes a first end connected to the applicator assembly 10, and a second end detachably connected to the container assembly 80. The transmission member 50 and the compression member 60 are provided in the coupling member 30. The operable member 40 is provided on a sidewall of the coupling member 30. A first valve 33 is arranged between the first end of the discharge assembly and the applicator assembly 10. A second valve 34 is arranged between a second end of the discharge assembly and the container assembly 80. In response to the movement of the operable member 40 under stress, the transmission member 50 acts on the compression member 60, such that the compression member 60 is compressed, and the material in the discharge assembly opens the first valve 33. When an external force on the operable member 40 disappears, the compression member 60 is extended to drive the operable member 40 and the transmission member 50 to be restored, and the material in the container assembly opens the second valve 34. The operable member 40 that is under stress can move toward an inner side of the makeup pen, or move forward and backward along the makeup pen, or slide along a circumferential direction of the makeup pen. The manner in which the stressed operable member moves is not limited, provided that the compression member is compressed.

Figure 3:
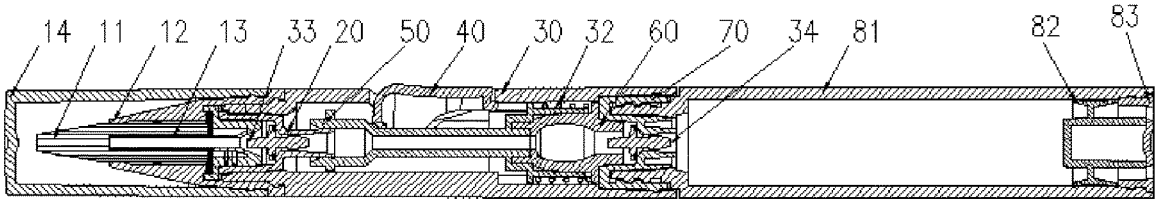
FIG. 3 is a schematic view of the structure after being pressed according to Embodiment 1 of the present application.
Figure 4:
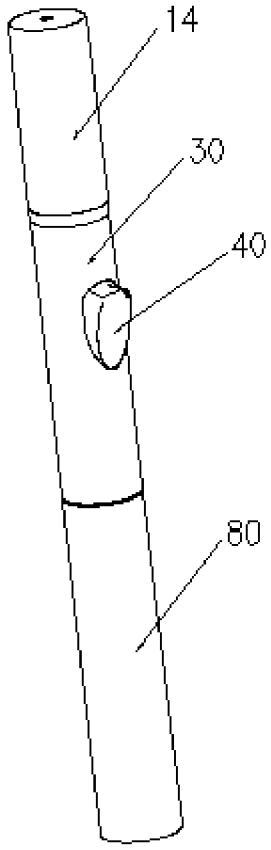
FIG. 4 is a perspective view according to Embodiment 1 of the present application.
Figure 5:
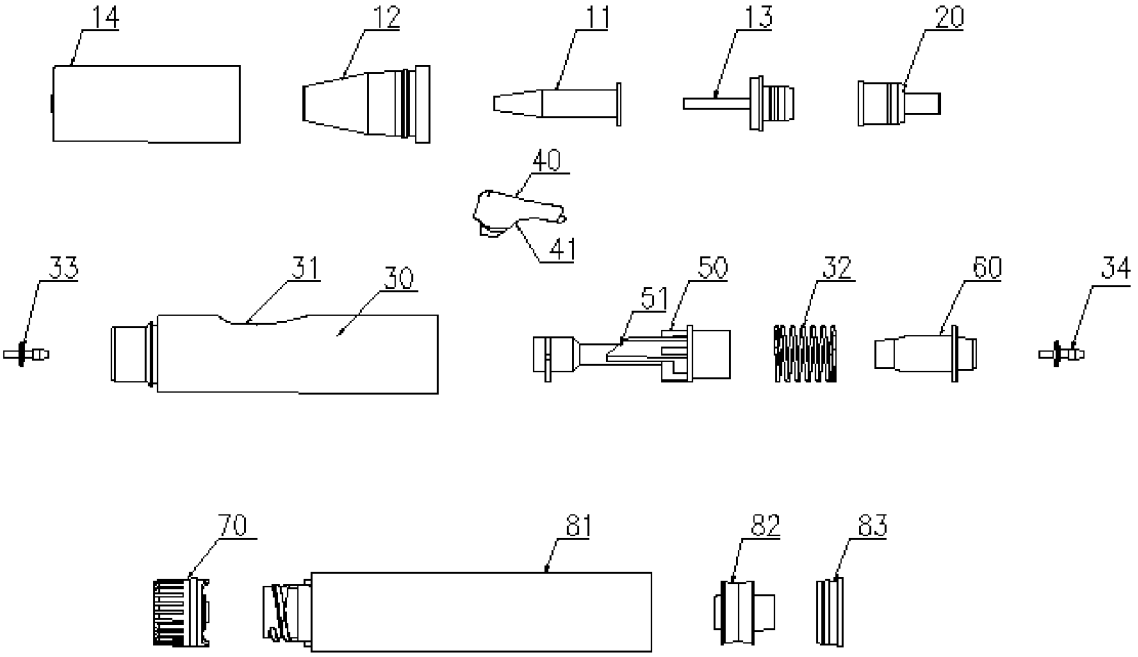
FIG. 5 is an exploded view according to Embodiment 1 of the present application.

The first end of the coupling member 30 is fixedly connected to the applicator assembly 10. The container assembly 80 is detachably provided at the second end of the coupling member 30. Optionally, the container assembly 80 is bolted or clamped at the second end of the coupling member 30. The container assembly 80 is configured to store a cosmetic material. The discharge assembly is configured to guide the material in the container assembly 80 to the applicator assembly 10. The applicator assembly 10 is configured for makeup. The discharge assembly is provided in the coupling member 30. Optionally, the applicator assembly 10, the discharge member, the coupling member 30, and the container assembly 80 are coaxial. The operable member 40 is movably provided on the sidewall of the coupling member 30. The operable member 40 abuts against the transmission member 50. A mounting groove 31 is formed in the sidewall of the coupling member 30. The operable member 40 is provided in the mounting groove 31. The operable member 40 may be a button, a key, a bump, etc. As shown in FIG. 1, FIG. 4, and FIG. 5, when the side-operated makeup pen is not used, the operable member 40 protrudes from the coupling member 30. The first valve 33 and the second valve 34 are closed, such that the discharge assembly does not communicate with the applicator assembly 10 and the container assembly 80. As shown in FIG. 3, when the side-operated makeup pen is used, and the operable member 40 is pressed down, the operable member 40 pushes the transmission member 50 rightward to compress the elastic compression member 60, the material in the compression member 60 is squeezed out to flow to the first valve 33 and open the first valve 33, and the material flows to the applicator assembly 10 through a gap between the first valve 33 and the discharge assembly. When the operable member 40 is loosened, the compression member 60 is extended to drive the transmission member 50 and the operable member 40 to be restored. Since the pressure in the discharge assembly is less than that in the container assembly 80, the material in the container assembly 80 opens the second valve 34 to flow to the discharge assembly until the pressures in the discharge assembly and the container assembly 80 are balanced, and the first valve 33 and the second valve 34 are closed again. In this case, the applicator assembly 10 is filled with the material for use. Since the operable member is provided on the sidewall of the makeup pen, the material can be added to the applicator assembly through a one-handed operation of the user, and the use is very convenient.

Figure 2:
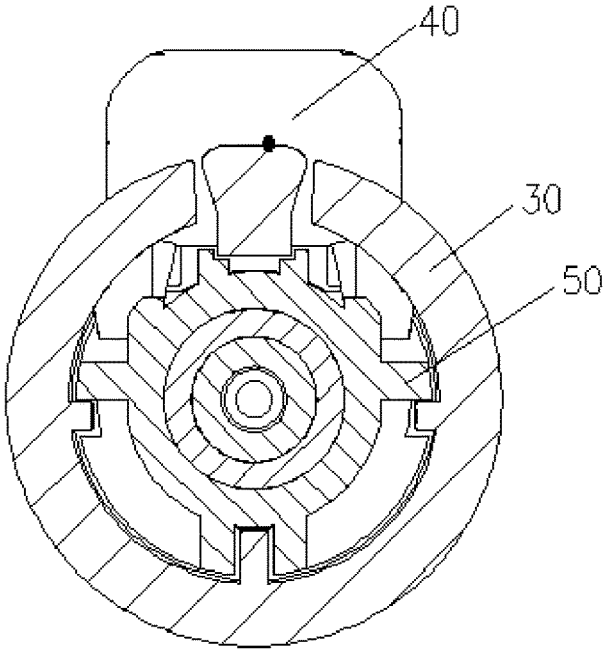
FIG. 2 is a sectional view along A-A in FIG. 1.

As shown in FIGS. 1-2, a first oblique surface 41 is provided on the operable member 40. A second oblique surface 51 cooperating with the first oblique surface 41 is provided on the transmission member 50. The operable member 40 can drive the transmission member 50 to move along an axial direction of the coupling member 30 to compress the compression member 60. The compression member 60 is subject to a uniform pressure of the transmission member 50 along an axial direction. The compression member 60 is compressed and shortened overall along the axial direction when under stress. When the external force disappears, the compression member is extended under the action of its elasticity. Therefore, the compression member is stressed uniformly to prolong its service life. If stressed along a radial direction, the compression member only deforms partially and is susceptible to fatigue without elasticity.

A material passage is formed in the transmission member 50. An accommodation cavity is formed in the compression member 60. The material passage and the accommodation cavity communicate with each other. Axial directions of the transmission member 50 and the coupling member 30 are limited by a guide rail and a guide groove. As shown in FIG. 1 and FIG. 5, the first oblique surface 41 and the second oblique surface 51 are attached. When the operable member 40 is pressed down, the operable member 40 acts on the axial direction of the transmission member 50 by the oblique surfaces, such that the transmission member slides rightward to compress the compression member 60, and the material in the accommodation cavity is squeezed out to flow to the applicator assembly 10. Optionally, as shown in FIG. 2, the transmission member 50 is provided with the guide rail along the axial direction, and the coupling member 30 is provided with the guide groove along the axial direction. Alternatively, the transmission member 50 is provided with the guide groove along the axial direction, and the coupling member 30 is provided with the guide rail along the axial direction. The guide rail is clamped into the guide groove to restrict the transmission member from sliding along the axial direction of the coupling member. The compression member 60 may be made of an elastomer or a rubber material, for example, a telescopic elastic bag. For example, the compression member 60 may be a rubber bag. There are no limits made on the shape of the compression member. Optionally, the compression member is a parallel corrugated pipe, an oblique corrugated pipe, etc.

An elastic member 32 is provided between the transmission member 50 and the compression member 60. The elastic member 32 includes a first end abutting against the transmission member 50 and a second end abutting against the compression member 60. The elastic member 32 is sleeved outside the compression member 60. When the compression member 60 is compressed, the elastic member 32 is also compressed. In this way, after the operable member is loosened, the operable member is restored quickly under the action of the resilience of the elastic member 32, which makes the user more efficient in operation and reduces the burden of the compression member. The elastic member 32 may be a plastic spring. All components in the makeup pen may be made of a plastic material, which facilitates recycling and meets the requirements of environmental protection.

In a possible implementation, the first valve 33 is arranged between the applicator assembly 10 and the transmission member 50, and the second valve 34 is arranged between the container assembly 80 and the compression member 60. As shown in FIGS. 1-2, the transmission member 50 is located on the left side of the compression member 60, and the operable member 40 drives the transmission member 50 to slide rightward to squeeze the compression member 60.

In another possible implementation, the first valve 33 is arranged between the applicator assembly 10 and the compression member 60, and the second valve 34 is arranged between the container assembly 80 and the transmission member 50. The transmission member is located on the right side of the compression member 60, and the operable member 40 drives the transmission member 50 to slide leftward to squeeze the compression member 60. The implementation herein is not illustrated in the figure.

The discharge assembly further includes a discharge rod 20 and a bottle shoulder 70. The discharge rod 20 is fixedly provided in the first end of the coupling member 30, and the discharge rod 20 is fixedly sleeved on the applicator assembly 10. The bottle shoulder 70 is fixedly provided in the second end of the coupling member 30. The first valve 33 is provided on the discharge rod 20 and can open or close. The second valve 34 is provided on the bottle shoulder 70 and can open or close.

As shown in FIG. 1 and FIG. 3, according to the first implementation in Embodiment 1, a first discharge port 21 is formed in the discharge rod 20. The first end of the transmission member 50 is movably sleeved at a tail portion of the discharge rod 20. The first valve 33 is provided in the first discharge port 21. A second discharge port 71 is formed in the bottle shoulder 70. The first end of the compression member 60 is fixedly provided at the second end of the transmission member 50. The second end of the compression member 60 is fixedly provided in the bottle shoulder 70. The second valve 34 is provided in the second discharge port 71. The discharge assembly includes the discharge rod 20, the transmission member 50, the compression member 60, and the bottle shoulder 70, which are sequentially arranged in the coupling member 30. The discharge rod 20 is fixedly inserted into the applicator assembly 10. The first end of the transmission member 50 is movably sleeved on the discharge rod 20, such that the transmission member 50 is not separated from the discharge rod 20 in operation. The first valve 33 is provided in the first discharge port of the discharge rod 20. When the first valve is attached to the discharge rod, the first discharge port is sealed, and the material in the discharge assembly does not flow to the applicator assembly. After the first valve is opened, the first discharge port is opened, and the material in the discharge assembly flows to the applicator assembly 10 through the first discharge port 21. The second end of the transmission member 50 is fixedly connected to the first end of the compression member 60. The second end of the compression member 60 is fixedly connected to the bottle shoulder 70. As shown in FIG. 3, when the transmission member 50 moves rightward, the compression member 60 is compressed, such that the material therein flows out. The bottle shoulder 70 is fixedly provided in the coupling member 30. The container assembly 80 is bolted or clamped to the bottle shoulder 70. The second valve 34 is provided in the second discharge port of the bottle shoulder 70. When the second valve is attached to the bottle shoulder, the second discharge port 71 is sealed, and the material in the container assembly 80 does not flow to the discharge assembly. When the second valve 34 is opened, the second discharge port 71 is opened, and the material in the container assembly 80 flows to the discharge assembly. The second implementation in Embodiment 1 differs from the first implementation in that the first end of the transmission member 50 is movably provided in the bottle shoulder 70, and the second end of the compression member 60 is fixedly connected to the tail portion of the discharge rod 20.

Each of the first valve 33 and the second valve 34 is a one-way valve. An opening direction of the first valve 33 is a direction from the discharge assembly to the applicator assembly 10. An opening direction of the second valve 34 is a direction from the container assembly 80 to the discharge assembly. The container assembly and the applicator assembly are connected by the discharge assembly. A discharge port between the applicator assembly and the discharge assembly is opened or closed under the control of a first valve. A discharge port between the container assembly and the discharge assembly is opened or closed under the control of a second valve. Therefore, the makeup pen has a desirable sealing function without material leakage. Since each of the first valve and the second valve is a one-way valve, the material or gas in the applicator assembly does not flow back to the discharge assembly, and the material or gas in the discharge assembly does not flow back to the container assembly, thereby ensuring the quality of the material and prolonging the service life of the material.

As shown in FIG. 1, FIG. 3 and FIG. 5, the makeup pen further includes an outer cover 14. The outer cover 14 covers the applicator assembly 10. The applicator assembly 10 includes an application head 11, a nib 12, and an application head seat 13. The application head 11 is fixedly provided on the application head seat 13, and the application head 11 communicates with a liquid passage in the application head seat 13. The nib 12 is fixedly sleeved outside the application head 11 and the application head seat 13. The application head 11 is extended out of the nib 12. The application head seat 13 is inserted into the application head 11. The first end of the coupling member 30 is fixedly provided between the nib 12 and the application head seat 13. The outer cover 14 covers the nib 12 to seal the application head 11. The material in the discharge assembly flows to the application head 11 through the liquid passage in the application head seat 13 for use.

As shown in FIG. 1, FIG. 3 and FIG. 5, the container assembly 80 includes a bottle 81, a piston 82, and a tail plug 83. The tail plug 83 is firmly plugged at the tail end of the bottle 81. The piston 82 is hermetically provided in the bottle 81 on the inner side of the tail plug 83. An air vent communicating with the outside is formed in the tail plug 83. The bottle 81 includes a head bolted in the bottle shoulder 70 and a tail provided with the tail plug 83. The bottle 81 and the tail plug 83 may be of a split structure and may also be of an integral structure. When the material in the bottle 81 is sucked into the discharge assembly, outside air enters the bottle through the air vent to keep pressures inside and outside the bottle balanced. By pushing the material with the piston, the material does not remain in the bottle, thereby improving the utilization rate of the material and reducing waste.

Figure 6:
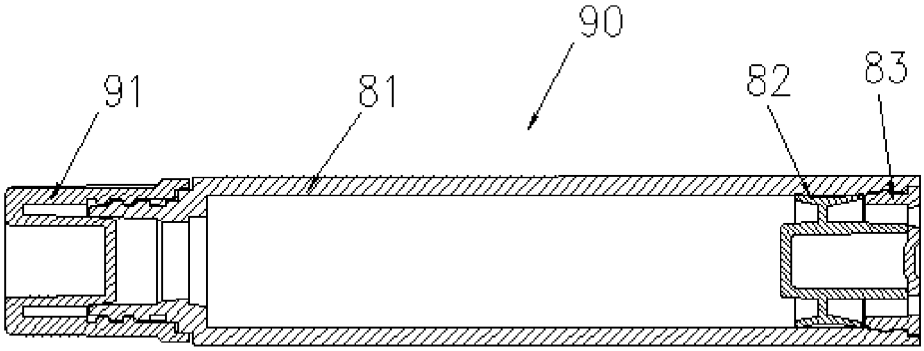
FIG. 6 is a sectional view of a replacement assembly according to the present application.
Figure 7:
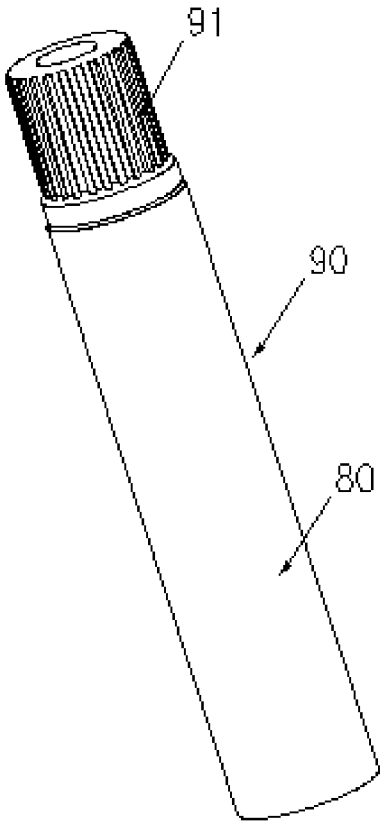
FIG. 7 is a perspective view of a replacement assembly according to the present application.

As shown in FIG. 6 and FIG. 7, the makeup pen further includes a replacement assembly 90. The replacement assembly 90 includes the container assembly 80 and a replacement cover 91. The replacement cover 91 covers the container assembly. Because of the replacement assembly 90 in the present application, when the material in the bottle 81 is used up, the replacement cover is screwed off, and the old bottle is replaced by a new one in the replacement assembly. Therefore, the applicator assembly and the press assembly are reusable to reduce the waste of resources.

Figure 8:
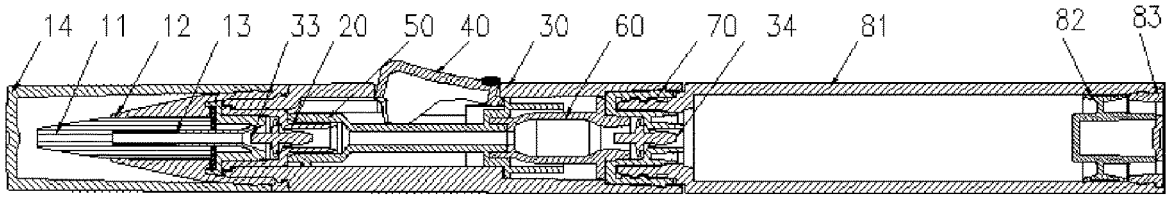
FIG. 8 is a schematic view of the structure before being pressed according to Embodiment 2 of the present application.
Figure 9:
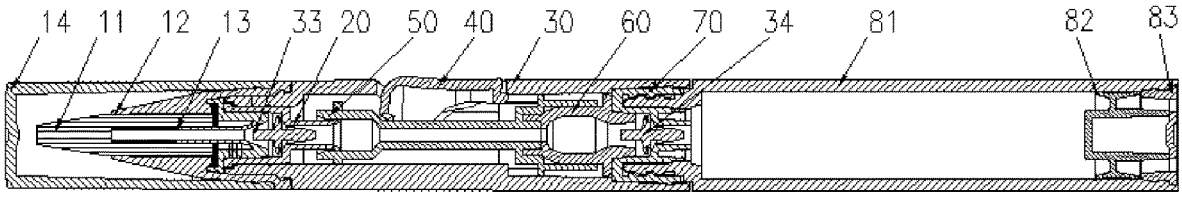
FIG. 9 is a schematic view of the structure after being pressed according to Embodiment 2 of the present application.

Embodiment 2: As shown in FIG. 8 and FIG. 9, the embodiment differs from Embodiment 1 in that there is no elastic member in the embodiment, and the operable member is restored by the resilience of the compression member 60.

Embodiment 3: A side-operated makeup pen includes an applicator assembly 10, a coupling member 30, an operable member 40, a discharge assembly, and a container assembly 80. The discharge assembly includes a transmission member 50 and a compression member that are connected to each other. An elastic member 32 is provided between the transmission member 50 and the compression member 60. The coupling member 30 includes a first end connected to the applicator assembly 10, and a second end detachably connected to the container assembly 80. The transmission member 50 and the compression member 60 are provided in the coupling member 30. The operable member 40 is provided on a sidewall of the coupling member 30. A first valve 33 is arranged between the first end of the discharge assembly and the applicator assembly 10. A second valve 34 is arranged between the second end of the discharge assembly and the container assembly 80. In response to a movement of the operable member 40 under stress, the transmission member 50 slides toward the compression member 60, the material in the discharge assembly opens the first valve 33, and the elastic member 32 is compressed. When the external force on the operable member 40 disappears, the elastic member 32 is extended to drive the transmission member 50 and the operable member 40 to be restored, and the material in the container assembly 80 opens the second valve 34. The embodiment differs from Embodiment 1 in that: The transmission member 50 is slidably connected to the compression member 60. The transmission member is slidably inserted into the accommodation cavity of the compression member 60. The compression member 60 is not elastic, specifically, the transmission member 50 directly squeezes out the material in the accommodation cavity while the compression member does not deform. The elastic member 32 is provided between the transmission member and the compression member. The elastic member includes a first end abutting against the transmission member, and a second end abutting against the compression member. The elastic member 32 is beneficial for the restoration of the transmission member 50 and the operable member 40.

A first oblique surface 41 is provided on the operable member 40. A second oblique surface 51 cooperating with the first oblique surface 41 is provided on the transmission member 50. The operable member 40 can drive the transmission member 50 to move along an axial direction of the coupling member 30 to compress the compression member 60.

The first valve 33 is arranged between the applicator assembly 10 and the transmission member 50, and the second valve 34 is arranged between the container assembly 80 and the compression member 60. Alternatively, the first valve 33 is arranged between the applicator assembly 10 and the compression member 60, and the second valve 34 is arranged between the container assembly 80 and the transmission member 50.

A second end of the transmission member 50 is slidably connected in the accommodation cavity of the compression member 60. When the transmission member 50 slides to the accommodation cavity of the compression member under the acting force of the operable member 40, the volume of the accommodation cavity of the compression member is reduced, and thus the material in the accommodation cavity opens the first valve 33 through the transmission member to flow toward the applicator assembly 10. Optionally, a piston member is sleeved at the second end of the transmission member 50. The piston member is airtightly attached to an inner wall of the accommodation cavity. A discharge hole is formed in the piston member.

The discharge assembly further includes a discharge rod 20 and a bottle shoulder 70. The discharge rod 20 is fixedly provided in the first end of the coupling member 30, and the discharge rod 20 is fixedly sleeved on the applicator assembly 10. The bottle shoulder 70 is fixedly provided in the second end of the coupling member 30. The first valve 33 is provided on the discharge rod 20 and can open or close. The second valve 34 is provided on the bottle shoulder 70 and can open or close.

Each of the first valve 33 and the second valve 34 is a one-way valve. An opening direction of the first valve 33 is a direction from the discharge assembly to the applicator assembly 10. An opening direction of the second valve 34 is a direction from the container assembly 80 to the discharge assembly.

The makeup pen further includes an outer cover 14. The outer cover 14 covers the applicator assembly 10. The applicator assembly 10 includes an application head 11, a nib 12, and an application head seat 13. The application head 11 is fixedly provided on the application head seat 13, and the application head 11 communicates with a liquid passage in the application head seat 13. The nib 12 is fixedly sleeved outside the application head 11 and the application head seat 13.

The container assembly 80 includes a bottle 81, a piston 82, and a tail plug 83. The tail plug 83 is firmly plugged at the tail end of the bottle 81. The piston 82 is hermetically provided in the bottle 81 on the inner side of the tail plug 83. An air vent communicating with the outside is formed in the tail plug 83.

The makeup pen further includes a replacement assembly 90. The replacement assembly 90 includes the container assembly 80 and a replacement cover 91. The replacement cover 91 covers the container assembly.

With Embodiment 1 as an example, the side-operated makeup pen has the following operation process:

Step 1: As shown in FIG. 1, when the side-operated makeup pen is not used, the operable member 40 protrudes from the coupling member 30. The first valve 33 and the second valve 34 are closed, such that the discharge assembly does not communicate with the applicator assembly 10 and the container assembly 80.

Step 2: As shown in FIG. 2, when the side-operated makeup pen is used, and the operable member 40 is pressed down, the operable member 40 pushes the transmission member 50 rightward to compress the compression member 60, the elastic member 32 is compressed, the material in the compression member 60 is squeezed out to flow to the first valve 33 and open the first valve 33, and the material flows to the applicator assembly 10 through the first discharge port in the discharge rod.

Step 3: When the operable member 40 is loosened, the operable member 40 is restored under the action of the elastic member 32, and the compression member 60 is restored. Since the pressure in the discharge assembly is less than that in the container assembly 80, the material in the bottle 81 opens the second valve 34 to flow to the compression member 60 until the pressures in the discharge assembly and the container assembly 80 are balanced, and the first valve 33 and the second valve 34 are closed again. In this case, the applicator assembly 10 is filled with the material for use.

It should be noted that those of ordinary skill in the art can further make variations and improvements without departing from the concept of the present application. These variations and improvements all fall within the protection scope of the present application. Therefore, the protection scope of the present application should be subject to the appended claims.

What is claimed is:

1. A side-operated makeup pen, comprising an applicator assembly, a coupling member, an operable member, a discharge assembly, and a container assembly, wherein the discharge assembly comprises a transmission member and a compression member, wherein the transmission member and the compression member are connected to each other; the compression member is elastic; the coupling member comprises a first end connected to the applicator assembly, and a second end detachably connected to the container assembly; the transmission member and the compression member are provided in the coupling member; the operable member is provided on a sidewall of the coupling member; a first valve is arranged between a first end of the discharge assembly and the applicator assembly; and a second valve is arranged between a second end of the discharge assembly and the container assembly, wherein a first oblique surface is provided on the operable member; a second oblique surface cooperating with the first oblique surface is provided on the transmission member; and the operable member is configured to drive the transmission member to move along an axial direction of the coupling member to compress the compression member, wherein the first valve is arranged between the applicator assembly and the transmission member, and the second valve is arranged between the container assembly and the compression member;

or, the first valve is arranged between the applicator assembly and the compression member, and the second valve is arranged between the container assembly and the transmission member, wherein the discharge assembly further comprises a discharge rod and a bottle shoulder; wherein the discharge rod is fixedly provided in the first end of the coupling member, and the discharge rod is fixedly sleeved on the applicator assembly; the bottle shoulder is fixedly provided in the second end of the coupling member; the first valve is provided on the discharge rod and is configured to open or close; and the second valve is provided on the bottle shoulder and is configured to open or close.

2. The side-operated makeup pen according to claim 1, wherein an elastic member is provided between the transmission member and the compression member; and the elastic member comprises a first end abutting against the transmission member, and a second end abutting against the compression member.

3. The side-operated makeup pen according to claim 2, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

4. The side-operated makeup pen according to claim 1, wherein each of the first valve and the second valve is a one-way valve; an opening direction of the first valve is a direction from the discharge assembly to the applicator assembly; and an opening direction of the second valve is a direction from the container assembly to the discharge assembly.

5. The side-operated makeup pen according to claim 1, further comprising an outer cover, wherein the outer cover covers the applicator assembly; the applicator assembly comprises an application head, a nib, and an application head seat, wherein the application head is fixedly provided on the application head seat, and the application head communicates with a liquid passage in the application head seat; and the nib is fixedly sleeved outside the application head and the application head seat.

6. The side-operated makeup pen according to claim 1, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

7. The side-operated makeup pen according to claim 6, further comprising a replacement assembly, wherein the replacement assembly comprises the container assembly and a replacement cover, wherein the replacement cover covers the container assembly.

8. The side-operated makeup pen according to claim 1, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

9. A side-operated makeup pen, comprising an applicator assembly, a coupling member, an operable member, a discharge assembly, and a container assembly, wherein the discharge assembly comprises a transmission member and a compression member, wherein the transmission member and the compression member are connected to each other; an elastic member is provided between the transmission member and the compression member; the coupling member comprises a first end connected to the applicator assembly, and a second end detachably connected to the container assembly; the transmission member and the compression member are provided in the coupling member; the operable member is provided on a sidewall of the coupling member; a first valve is arranged between a first end of the discharge assembly and the applicator assembly; and a second valve is arranged between a second end of the discharge assembly and the container assembly, wherein a first oblique surface is provided on the operable member; a second oblique surface cooperating with the first oblique surface is provided on the transmission member; and the operable member is configured to drive the transmission member to move along an axial direction of the coupling member to compress the compression member, wherein the first valve is arranged between the applicator assembly and the transmission member, and the second valve is arranged between the container assembly and the compression member;

or, the first valve is arranged between the applicator assembly and the compression member, and the second valve is arranged between the container assembly and the transmission member, wherein the discharge assembly further comprises a discharge rod and a bottle shoulder; wherein the discharge rod is fixedly provided in the first end of the coupling member, and the discharge rod is fixedly sleeved on the applicator assembly; the bottle shoulder is fixedly provided in the second end of the coupling member; the first valve is provided on the discharge rod and is configured to open or close; and the second valve is provided on the bottle shoulder and is configured to open or close.

10. The side-operated makeup pen according to claim 9, wherein a second end of the transmission member is slidably connected in the compression member.

11. The side-operated makeup pen according to claim 9, wherein each of the first valve and the second valve is a one-way valve; an opening direction of the first valve is a direction from the discharge assembly to the applicator assembly; and an opening direction of the second valve is a direction from the container assembly to the discharge assembly.

12. The side-operated makeup pen according to claim 9, further comprising an outer cover, wherein the outer cover covers the applicator assembly; the applicator assembly comprises an application head, a nib, and an application head seat, wherein the application head is fixedly provided on the application head seat, and the application head communicates with a liquid passage in the application head seat; and the nib is fixedly sleeved outside the application head and the application head seat.

13. The side-operated makeup pen according to claim 9, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

14. The side-operated makeup pen according to claim 13, further comprising a replacement assembly, wherein the replacement assembly comprises the container assembly and a replacement cover, wherein the replacement cover covers the container assembly.

* * * * *